United States Patent [19]

Basseches et al.

[11] 4,425,680

[45] Jan. 17, 1984

[54] NAPKIN CLIP

[76] Inventors: Harold Basseches, 618 N. Glenwood St., Allentown, Pa. 18104; Donald R. Oswald, 24 Trexler Rd., Schnecksville, Pa. 18078

[21] Appl. No.: 376,026

[22] Filed: May 7, 1982

[51] Int. Cl.[3] ..... A45F 5/04

[52] U.S. Cl. ..... 24/7; D7/72

[58] Field of Search ..... 24/7, 8, 9, 49 C, 49 CF, 24/72.5; D7/72; 40/11 R, 23 R

[56] References Cited

U.S. PATENT DOCUMENTS

| | | | |
|---|---|---|---|
| D. 45,576 | 4/1914 | Thamm | 24/7 X |
| 836,458 | 11/1906 | Peters | 24/8 |
| 2,247,372 | 7/1941 | Hart | 24/8 |
| 2,287,717 | 6/1942 | Barnes | 24/8 |
| 3,462,863 | 8/1969 | Reeves | 40/23 R X |

FOREIGN PATENT DOCUMENTS

| | | | |
|---|---|---|---|
| 417582 | 11/1910 | France | 24/8 |

*Primary Examiner*—Robert P. Swiatek

*Attorney, Agent, or Firm*—Mark T. Basseches; Paula T. Basseches

[57] ABSTRACT

The present invention is directed to a napkin clip device, and more particularly to a device which may be utilized in the manner of a tie clip and which also functions to hold a napkin in selected position. The device is especially adaptable for use as an advertising medium.

2 Claims, 5 Drawing Figures

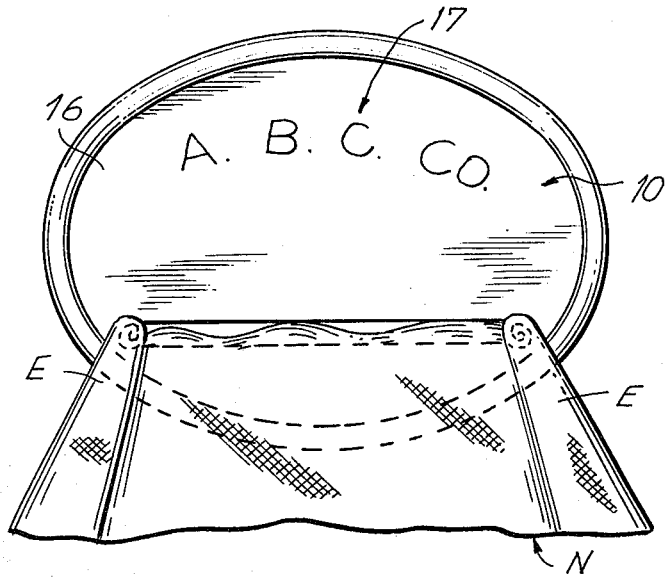
FIG. 1
FIG. 2
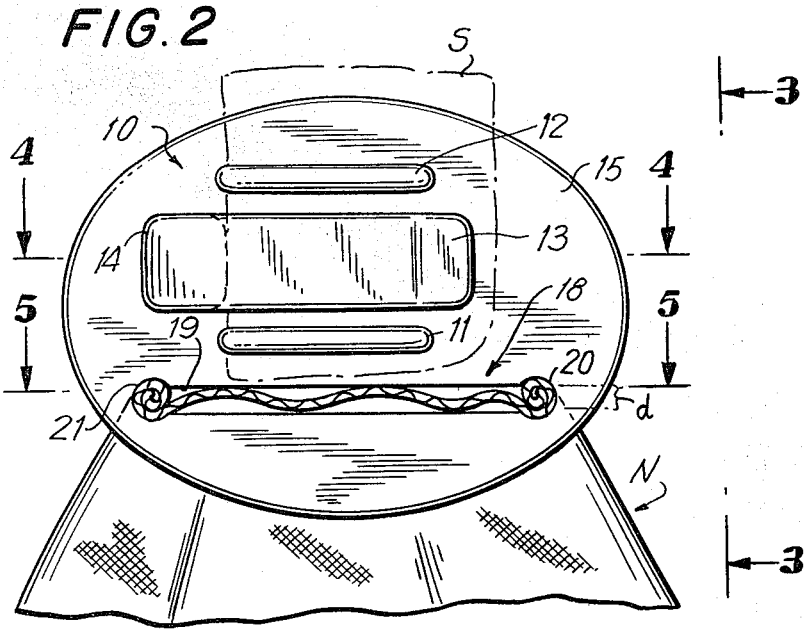
FIG. 3
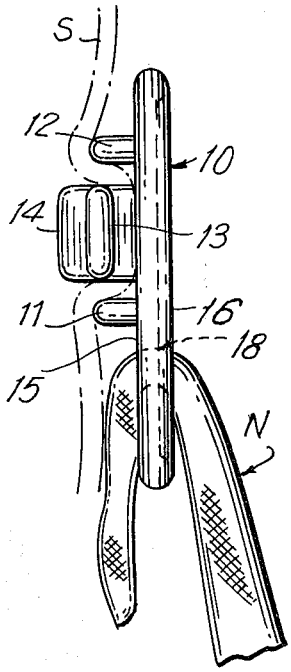
FIG. 4
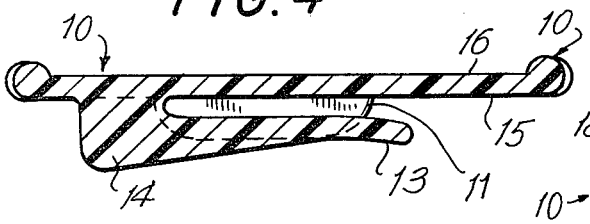
FIG. 5
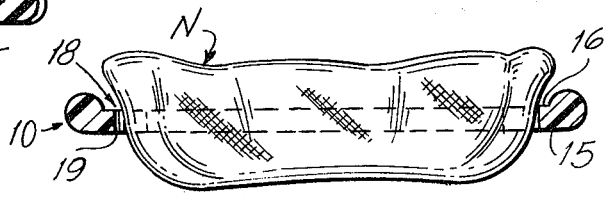

NAPKIN CLIP

BACKGROUND OF THE INVENTION

1. Field of the Invention

The present invention is in the field of novelty devices and pertains more particularly to a device for holding a napkin to the clothing of a diner. The device is especially useful as an edvertising medium.

2. The Prior Art

Various clip mechanisms are known per se as, for instance, tie clips which are lapped over the tie and shirt of a wearer to hold the tie in a desired position. Similarly it is conventional for a diner to tuck a napkin into the fly opening of his shirt or jacket.

SUMMARY OF THE INVENTION

The present invention may be summarized as directed to a napkin clip, and more particularly to an advertising medium susceptible of being worn on the shirt or jacket of a diner, the clip functioning in addition as a means for securely holding a napkin in place.

It is an object of the invention to provide an advertising medium in the form of a clip which is readily attachable to the garment of a wearer, which clip may securely support a napkin in the desired position and also function, as a result of indicia imprinted on the exposed surface thereof, as a promotional or advertising device.

To attain these objects and such further objects as may appear herein or be hereinafter pointed out, reference is made to the accompanying drawings, forming a part hereof, in which:

FIG. 1 is a front elevational view of a device in accordance with the invention with a napkin in place;

FIG. 2 is a rear elevational view of the device;

FIG. 3 is a side elevational view thereof taken in the direction of the arrows 3—3 of FIG. 2;

FIG. 4 is a section taken on the line 4—4 of FIG. 2;

FIG. 5 is a section taken on the line 5—5 of FIG. 2.

Turning now to the drawings, there is shown in FIGS. 1 and 2 the front and rear faces, respectively, of a napkin clip in accordance with the invention. Preferably the device may be molded of a resilient polymeric material as a unitary element.

The device comprises a pallet or body portion 10 having on its rear face a spaced pair of parallel ribs 11, 12. An attachment finger member 13 includes a root end portion 14 integrally formed with or bonded to the rear face 15 of the pallet at a position between the ribs 11 and 12.

As will be readily understood, the ribs 11, 12 and attachment finger 13 may be sleeved into the fly of the shirt portions of a wearer such that the wearer's tie and perhaps also a portion of his shirt are clamped in position, whereby the device is securely anchored in a desired location. Manifestly, the specific clamping mechanism described hereinabove is for illustration purposes only and alternate means for attaching the device onto the clothing of the wearer may be suitably substituted therefor.

The front face 16 of the device may include an area 17 adjacent the upper portions of the front face wherein indicia, such as an advertising slogan, company identification or the like may be imprinted.

The pallet member 10 is formed with a through-going napkin retention slot 18 which comprises an elongate central portion 19 and terminal enlargement portions 20, 21.

The device is used by threading a corner of the napkin N through the central portion 19 of slot 18 and drawing the corner inwardly in the direction from the front face 16 toward the rear face 15. In the course of such movement, it will be appreciated that when the transverse dimension of the napkin exceeds the distance between the enlarged terminal portions 20, 21, progressive convolutions of the marginal edges E of the napkin will occur, with the convolutions progressively enlarging to an increased circular configuration until the bulk of the material substantially fills the enlarged portions 20, 21 such that a wedging effect is experienced. When such wedging effect occurs the napkin will be found to be firmly gripped against inadvertent removal from the body portion and the user may be assured that the napkin will remain in position during his repast.

Preferably the transverse dimension d of the portions of the slot 19 between enlargements 20 and 21 is only slightly greater than the thickness of the napkin, whereby bunching up of the napkin centrally within the slot is prevented and the coiling and wedging action of the napkin in registry with the enlargements 20 and 21 is promoted.

A desirable feature of the invention resides in the fact that as the napkin is drawn through the slot, due to the convoluting action aforesaid the area of the napkin within the slot tends to spread or become tautened laterally whereby the widest possible spreading of the napkin and, hence, the most effective coverage thereby is fostered.

As will be apparent to those skilled in the art and made conversant with the instant disclosure, numerous variations in details of construction may be made without departing from the spirit of the invention. Accordingly the invention is to be broadly construed within the scope of the appended claims.

Having thus described the invention and illustrated its use, what is claimed as new and is desired to be secured by Letters Patent is:

1. A novelty device comprising a napkin clip integrally formed of rigid resilient polymeric material having a front face and a rear face generally parallel thereto, attachment means on said rear face for securing said clip to the clothing of the wearer, said attachment means comprising a finger member spaced from and generally parallel to said rear face and a pair of ribs extending rearwardly from said rear face at positions respectively immediately above and below the upper and lower edges of said finger member, a slot formed through said body portion adjacent the lower end thereof and extending generally parallel to said finger member, said slot having a transverse dimension slightly greater than the thickness of a napkin to be used therewith, the distal ends of said slot being defined by generally circlar enlargement portions, the diameter of said enlargement portions being a multiple of said transverse dimension whereby a napkin corner inserted through said slot and advanced in a direction from said front to said rear face is supported generally flatwise in the area between said enlargement portions and is caused to bunch or convolute in said enlargement portions responsive to the width of the napkin passed through said slot exceeding the spacing of said enlargement portions, the combination including an indicia receiving area on said front face of said body portion in the area above said slot.

2. A clip in accordance with claim 1 wherein the rearmost portions of said ribs extend rearwardly a distance beyond the forwardmost portion of said finger member.

* * * * *